US009010074B2

(12) United States Patent
Lemke et al.

(10) Patent No.: US 9,010,074 B2
(45) Date of Patent: Apr. 21, 2015

(54) PACKAGING UNIT METHOD

(71) Applicant: PCO Group GmbH, Garmisch-Partenkirchen (DE)

(72) Inventors: Stefan Lemke, Dassow (DE); Bernhard Wettlaufer, Garmisch-Partenkirchen (DE)

(73) Assignee: PCO Group GmbH, Garmisch-Partenkirchen (DE)

( * ) Notice: Subject to any disclaimer, the term of this patent is extended or adjusted under 35 U.S.C. 154(b) by 0 days.

(21) Appl. No.: 14/298,162

(22) Filed: Jun. 6, 2014

(65) Prior Publication Data

US 2014/0283488 A1 Sep. 25, 2014

Related U.S. Application Data

(62) Division of application No. 12/465,773, filed on May 14, 2009, now abandoned.

(30) Foreign Application Priority Data

Feb. 9, 2009 (EP) ..... 09001765

(51) Int. Cl.

| | |
|---|---|
| ***B65D 5/42*** | (2006.01) |
| ***B65B 29/00*** | (2006.01) |
| ***B65D 5/48*** | (2006.01) |
| ***B65D 5/50*** | (2006.01) |
| ***B65D 71/00*** | (2006.01) |

(52) U.S. Cl.

CPC ..... *B65D 5/42* (2013.01); *B65D 5/48002* (2013.01); *B65D 5/5007* (2013.01); *B65D 71/00* (2013.01); *B65B 29/00* (2013.01)

(58) Field of Classification Search

USPC ..... 229/120.08; 220/738; 206/139; 493/912, 152; 53/484

See application file for complete search history.

(56) References Cited

U.S. PATENT DOCUMENTS

| | | | | |
|---|---|---|---|---|
| 1,168,565 | A | | 1/1916 | Rosenwald |
| 2,692,077 | A | * | 10/1954 | Kuhlman ..... 206/521 |
| 2,794,585 | A | | 6/1957 | Wagner |
| 3,013,710 | A | * | 12/1961 | Kronson et al. ..... 229/117.07 |
| 3,114,474 | A | | 12/1963 | Davis |
| 3,241,738 | A | | 3/1966 | Freiman |
| 3,343,671 | A | | 9/1967 | Weinstein |

(Continued)

FOREIGN PATENT DOCUMENTS

| | | |
|---|---|---|
| DE | 202007014277 | 1/2008 |
| EP | 1018471 | 7/2000 |

(Continued)

*Primary Examiner* — Gary Elkins
*Assistant Examiner* — Christopher Demeree
(74) *Attorney, Agent, or Firm* — Greer, Burns & Crain, Ltd.

(57) ABSTRACT

A method of using a packaging unit with a selected beverage container comprises obtaining a packaging unit having a receiving chamber for popcorn or the like and a square pocket coupled to the outside of the receiving chamber, a lower end portion of the pocket having one or more strip-shaped wall sections; selecting either a conical beverage cup or a beverage bottle; configuring the pocket based on the configuration of the selected beverage container; and inserting the selected beverage container into the correspondingly configured pocket, wherein in a first configuration, the conical beverage cup is held in a clamp seat, or in a second pocket configuration the beverage bottle is supported on a partial bottom support member formed by the strip-shaped wall sections.

6 Claims, 2 Drawing Sheets

(56) References Cited

U.S. PATENT DOCUMENTS

| | | | |
|---|---|---|---|
| 3,385,502 | A | 5/1968 | Pilger |
| 4,284,205 | A | 8/1981 | Hirata |
| 4,491,220 | A | 1/1985 | Daviss |
| 5,730,289 | A | 3/1998 | Cappels |
| 5,775,570 | A | 7/1998 | Kim |
| 6,227,441 | B1 | 5/2001 | Sagel et al. |
| 6,637,645 | B2 | 10/2003 | Ferguson |
| 6,644,540 | B2 | 11/2003 | Jamitzky et al. |
| 2007/0199835 | A1 | 8/2007 | Cook et al. |

FOREIGN PATENT DOCUMENTS

| | | |
|---|---|---|
| EP | 1241104 | 6/2006 |
| GB | 965695 | 8/1964 |
| GB | 2344812 | 6/2000 |

* cited by examiner

PACKAGING UNIT METHOD

CROSS-REFERENCE

This application is a divisional application of co-pending U.S. patent application Ser. No. 12/465,773, filed May 14, 2009.

FIELD OF THE INVENTION

The present invention relates to packaging unit comprising a receiving chamber for popcorn or the like and a pocket which is arranged on the receiving chamber on the outside and is square in ground plan and is dimensioned such that a beverage cup can be inserted in a clamp seat into the pocket. The packaging unit preferably consists of cardboard, but it may also be made from plastics.

BACKGROUND OF THE INVENTION

It is widely known that e.g. people who are visiting movie theaters or so-called multiplexes take along popcorn, corn chips, or the like, together with a drink into the performance room; these were bought by them at a booth or in a sales room of the movie theater before. Popcorn, or the like, is offered in a bag or a packaging made from cardboard and the drink is offered in a separate beverage cup. It is quite uncomfortable for a visitor to transport and hold the two separate packaging units, for which he/she needs both hands.

The same problem can be observed in the case of other events, such as sports events, at fairs or exhibitions when visitors have bought a bag or a box containing food or edibles and a drink.

U.S. Pat. No. 4,491,220 discloses a packaging unit with a receiving chamber for popcorn or the like, in the case of which a flexible annular band, into which a drink cup can be inserted, is adhered to the receiving chamber on the outside.

EP-A-1018471 discloses a packaging unit with a receiving chamber where two side walls have annular attachments into which a corresponding drink cup can be inserted. The receiving chamber is provided with a handle on which the assembly is carried.

EP1241104B1 discloses a packaging unit of the aforementioned type in which a receiving chamber and a pocket are made from a one-part blank, the pocket being dimensioned such that a conical drink cup can be inserted into the pocket in a clamp seat. The pocket can be gripped around by a user's hand for carrying the packaging unit.

In many cases drinks are for instance offered in movie theaters not only in beverage cups, but also in bottles, such as PET bottles, the bodies of which have a smaller diameter than a beverage cup, so that such a PET bottle cannot be clamped in the pocket of the already known packaging unit. A PET bottle would fall through the pocket downwards because the pocket of the already known packaging unit is without a bottom.

SUMMARY OF THE INVENTION

It is the object of the present invention to provide a packaging unit in the pocket of which a beverage cup or a bottle containing a drink can optionally be held in a safe way. The packaging unit should here also be producible in an easy and inexpensive way.

This object is achieved according to the invention by a packaging unit comprising a receiving chamber for popcorn or the like and a pocket which is arranged on the receiving chamber on the outside thereof and is square in ground plan and is dimensioned such that a beverage cup can be inserted in a clamp seat into the pocket, the pocket having a lower end portion and sidewalls. On the lower end portion of the pocket, at least one, preferably two strip-shaped wall sections are cut free laterally from the side walls of the pocket by incisions extending in parallel with a lower edge of the pocket at corners of the pocket that are spaced apart from the receiving chamber. The incisions extend at the same height of the pocket. The ends of each of the strip-shaped wall sections have fold lines respectively formed extending in a direction perpendicular to the sections, so that the strip-shaped wall sections can be bent around the fold lines into the interior of the pocket.

Advantageous developments of the invention are described below.

The invention provides a packaging unit comprising a receiving chamber provided with a bottom for receiving popcorn or the like, wherein a mounting, called "pocket", is secured to the receiving chamber on the outside and a beverage cup can be inserted into said mounting. The packaging unit is preferably made from cardboard of a rigid paper quality or, for example, also from plastics.

According to the invention, it is intended that on the lower end portion of the pocket at least one strip-shaped wall section, preferably two strip-shaped wall sections are cut free in their longitudinal direction from the side walls of the pocket, which extend in parallel with the lower edge of the pocket each time at both sides of the corners of the pocket, which are spaced apart from the receiving chamber, the upper edges of the strip-shaped wall sections extending at the same height of the pocket, and that at the two ends of the strip-shaped wall sections fold lines are respectively formed extending in a direction perpendicular to said wall sections, so that the strip-shaped wall sections can be pivoted or bent around the fold lines into the interior of the pocket.

In this configuration a preferably conical beverage cup can be inserted in a clamp seat into the pocket, if necessary, as is known in the already known packaging unit. However, if a beverage bottle is to be carried along in the pocket, the at least one strip-shaped wail section, preferably two strip-shaped wall sections are pressed inwards into the interior of the pocket, the two side walls, from which a respective strip-shaped wall section is cut free, and the strip-shaped wall section being elastically deformed, and the strip-shaped wall sections then assuming a stable position in the interior of the pocket, from which they cannot independently return into the initial state again. The cut-free strip-shaped wall sections project here into the interior of the pocket to such an extent that a standard beverage bottle, such as a PET bottle, can be put on the upper edges of the strip-shaped wall sections in such a way that the bottle is safely held in the pocket. The pocket can in this instance also be gripped around by a user's hand so as to transport the receiving chamber with the popcorn or the like and the beverage bottle.

In an advantageous development of the invention, it is intended that two strip-shaped wall sections are designed such that they are each cut free by a single incision spaced apart from the lower edge of the side walls, which severs the material of the side walls. The incisions enclosing two neighboring corners of the pocket are here positioned at the same level. At the ends of the two strip-shaped wall sections preferably a corresponding fold line extends towards the lower edge of the strip-shaped wall sections and thus towards the lower edge of the side walls. As a rule, these prefabricated fold lines could be replaced by later bending lines, but this might not be so expedient. On the associated corners of the pocket, which is preferably square in ground plane, vertical fold lines also extend up to the lower edge of the pocket.

In an alternative embodiment, it may be that the cut-free strip-shaped wall sections are formed at a distance from the lower edge of the pocket, i.e. by two incisions positioned one above the other in parallel. In this instance, too, at the ends of the strip-shaped wall sections, folds lines which preferably extend in a direction perpendicular thereto are recessed into the cardboard (or plastic material).

In further details, it is suggested that the cut-free strip-shaped wall sections extend each over about half the width of the side walls of the pocket adjoining the receiving chamber and over about a third of the central side wall. When the pocket has square dimensions of about 60×60 millimeters, two strip-shaped wall sections are thus cut free with a length of 30 millimeters on the side walls adjoining the receiving chamber and with a side length (extending over the corner) of about 20 millimeters from the central side wall. The strip-shaped wall sections preferably have a height of about 10 to 15 millimeters, the wall sections having an ad equate strength at a standard cardboard thickness for carrying a PET bottle positioned thereon.

Furthermore, it is advantageously suggested that the receiving chamber and the pocket should be made from a one-part blank. This considerably simplifies the manufacture of the packaging unit. In further details, it is intended that the innermost side part of the receiving chamber in the blank passes into the innermost side part of the pocket, and that the outermost side parts of the receiving chamber and the pocket pass each via a fold line into fastening tongues. The fastening tongue of the receiving chamber is mounted on the inside of the innermost side part while the fastening tongue of the pocket is mounted on the outside on the outermost side part of the receiving chamber, so that the outermost side part of the receiving chamber forms a side part of the pocket. As a result, the blank from which the packaging unit is made can be reduced in its size. Fastening is carried out by gluing whenever the packaging unit is made from cardboard, while sealing is also possible in the case of a packaging unit of plastics.

Furthermore, it should be noted that another embodiment is also within the scope of the invention, wherein the pocket is secured as a firstly separated element with two fastening tongues on the outside to the receiving chamber, preferably it is glued thereto. In this instance the two outer side parts of the pocket are provided with fastening tongues. The pocket is here also preferably fastened in a corner area of the receiving chamber, like in the case of a one-part blank of the packaging unit.

The receiving chamber has preferably a cornered shape, which may e.g. be rectangular or square, when viewed in ground plan. When according to a further suggestion of the invention the pocket is fastened in the area of a corner, this entails a particularly stable unit made up of receiving chamber and pocket.

The beverage cup has preferably the shape of a cup which is slightly conically enlarged upwards and which is insertable into the pocket in a clamp seat. When the beverage cup has small dimensions, so that it cannot be clamped into the pocket, it is nevertheless held safely in the pocket, if the cut-free strip-shaped wall sections of the side walls of the pocket, which are provided according to the invention, are pivoted or pressed inwards, the sections being safely held in this inwardly shifted position by the side walls of the pocket and forming a support for the cup, for instance a PET bottle. It may here be enough that a single cut-free strip-shaped wall section is shifted inwards.

While the receiving chamber for receiving popcorn or the like has a bottom, this is consequently not intended in the case of the pocket. With a very simple measure, namely by cutting free one or two strip-shaped wall sections, the same effect can be created, after the strip-shaped wall sections have been pressed inwards, as if the pocket had a bottom.

Furthermore, it is intended that the pocket is formed of side parts that pass into one another via fold lines. It is here expedient that the fold lines extend in parallel with each other, so that the pocket has a constant cross-section over its height. This, however, is not absolutely necessary, but the fold lines can also extend at an angle relative to one another, so that the pocket is enlarged upwards. Three side parts are expediently provided that preferably have the same width so that the pocket (before insertion of a beverage cup) has a square ground plane. The fourth side is formed by the associated side part of the receiving chamber.

It is however also within the scope of the invention that the pocket consists of four side parts of its own, of which one is glued on the outside to the receiving chamber.

Hence, the invention provides a packaging unit which can be produced in an easy and inexpensive way and which comprises a receiving chamber for popcorn or the like and a pocket into which a preferably conical beverage cup or a beverage bottle of a smaller diameter can optionally be inserted, so that the food or edibles and the associated beverage can be transported with one hand of a user.

BRIEF DESCRIPTION OF THE DRAWINGS

Further details of the invention will become apparent from the following description of an embodiment of the packaging unit according to the invention and from the drawings, in which.

DETAILED DESCRIPTION OF A PREFERRED EMBODIMENT

Figure 1:
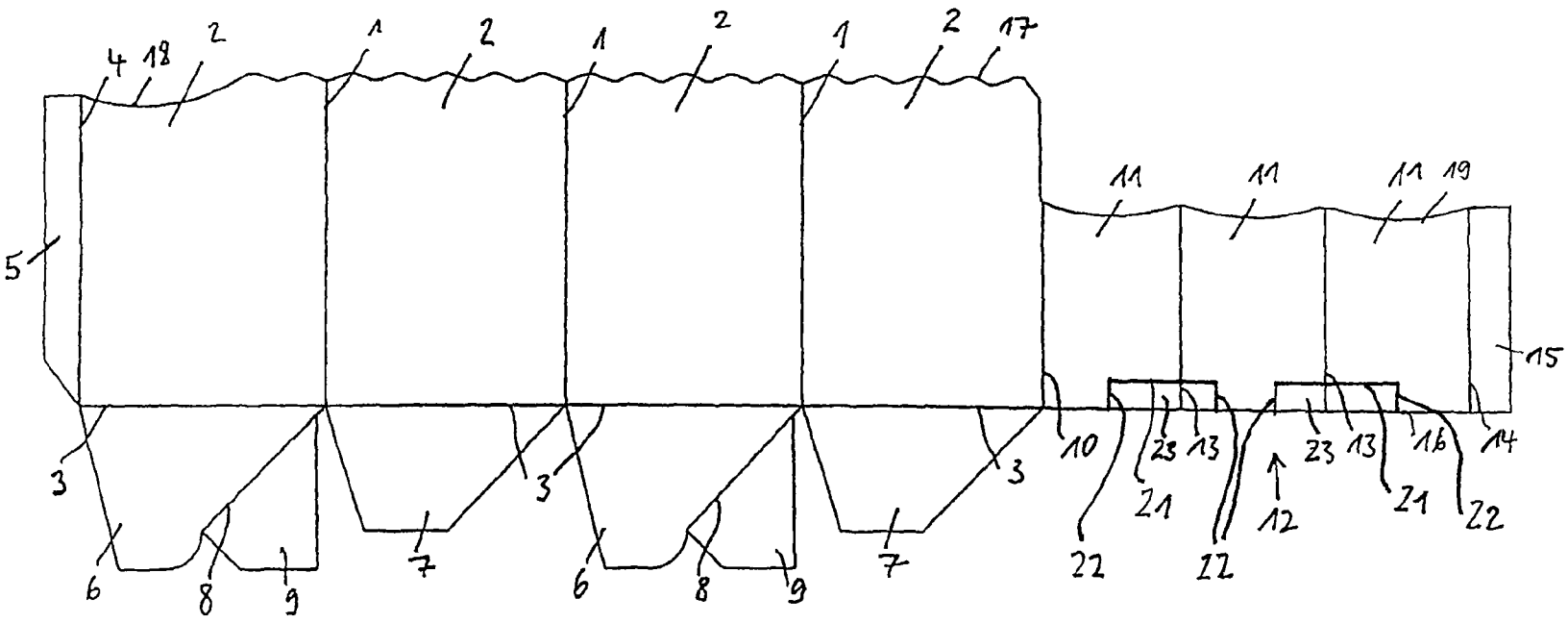
FIG. 1 shows a one-part blank of a packaging unit according to the invention.

The blank illustrated in FIG. 1 shows four side parts 2 of a receiving chamber 21*a* for receiving popcorn or the like, the side parts 2 being separated from one another by hinge folds 1 and passing at their lower edges via further hinge folds 3 into bottom parts. The side part 2 that is the left one in the figure passes via a further hinge fold 4 into an adhesive tongue 5 which is adhesively fastened to the inside of the right side part 2.

The alternately arranged bottom parts 6 and 7 grip over one another in the erected state of the packaging unit, the bottom parts 6 passing via inclined hinge folds into bottom sections 9 which are glued to the neighboring bottom parts 7.

The side part 2 of the receiving chamber that is the right one in the figure preferably passes via a fold line 10 into the side parts 11 of the insertion pocket. The side parts 11 are subdivided by hinge folds 13, followed via a fold line 14 by an adhesive tongue 15 which is adhesively fastened to the outside of the left side part 2 of the receiving chamber 21. The lower edges 16 of the side parts 11 are in alignment with the hinge folds 3 and the lower edges of the side parts 2, respectively.

The upper edges 17 of the side parts 2 have a corrugated shape, the left side part 2 having a section 18 shaped in the form of a circular arc.

The upper edges 19 of the side parts 11 have the shape of a circular arc extending in symmetry with the central longitudinal axis of the side parts 11.

The side parts 11 of the insertion pocket 12 contain two incisions 21 that extend at the same distance relative to the lower edges 16 of the side parts 11 and sever the wall of the side parts, whereby strip-shaped wall sections 23 are formed that are cut free at the side. Each section 21 extends over about half the width of the left side part and right side part, respectively, and over about a third of the width of the central side part 11, passing over the hinge fold 13. Recessed hinge folds 22 extend at both lateral ends of the incisions 21 up to the lower edge 16.

Figure 2:
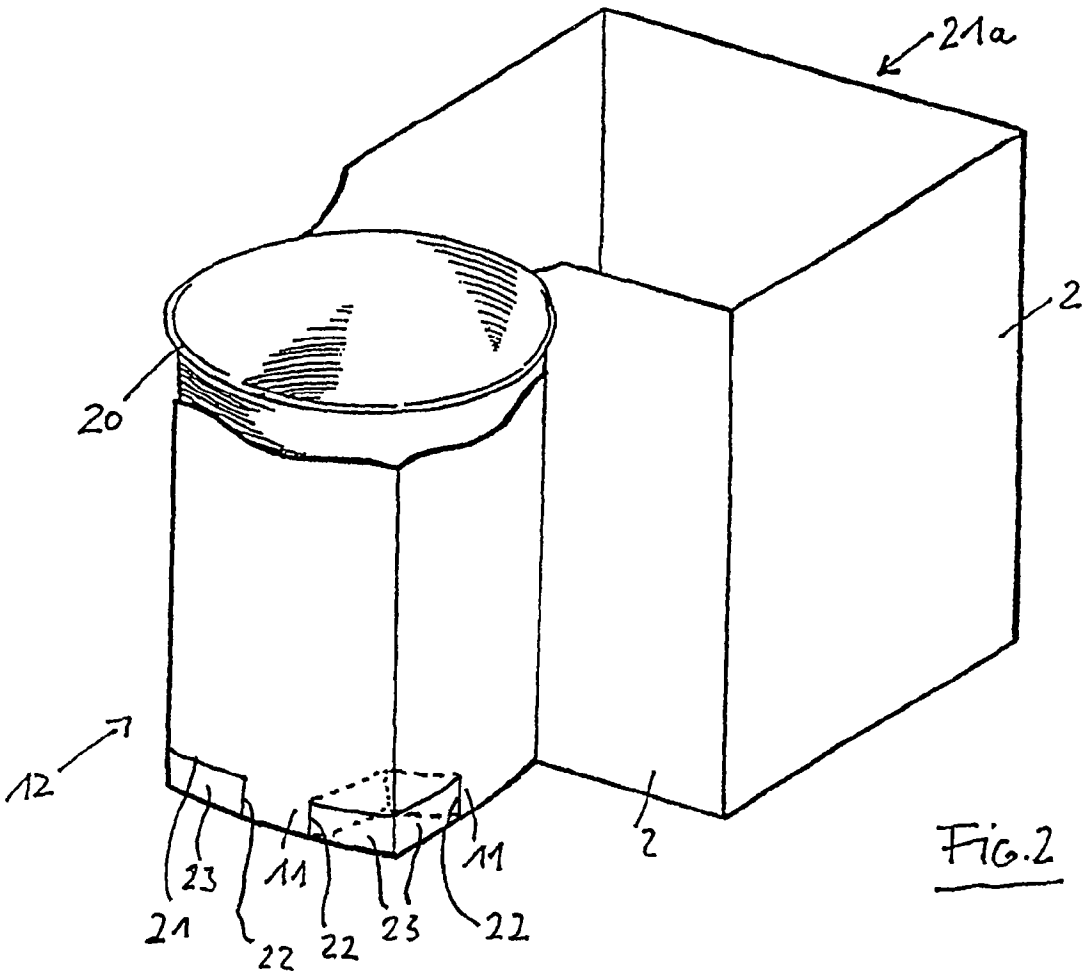
FIG. 2 is a perspective view of the packaging unit according to FIG. 1.

The packaging unit which is formed from the described blank is shown in FIG. 2 in a state in which a beverage cup 20 is inserted into the pocket 12. The beverage cup 20 is positioned in a clamp seat in the pocket 12, whereby the beverage cup 20 is safely held therein. A user can comfortably carry the packaging unit in said state by gripping around the pocket 12 with one hand. If a PET bottle is to be inserted into the pocket 12, the laterally cut-free wall sections are pivoted around the fold lines 22 inwards, as shown in broken line in FIG. 2 for the right wall section 23.

What is claimed is:

1. A method of using a packaging unit with a selected beverage container having a configuration, the method comprising the steps of:

obtaining a packaging unit having a receiving chamber for popcorn or the like and a pocket coupled to the outside of the receiving chamber, wherein the pocket is square in plan and is dimensioned such that a conical beverage container is inserted in a clamp seat into the pocket, wherein on a lower end portion of the pocket, one or more strip-shaped wall sections are partially cut free at one or more respective corners of the pocket in parallel with a lower edge of the pocket, the one or more strip-shaped wall sections being spaced apart from the receiving chamber, wherein the pocket further comprises fold lines at each end of the strip-shaped wall sections, and wherein the strip-shaped wall sections are bent around the fold lines and folded into the interior of the pocket to form a bottom support member;

forming the pocket into a first pocket configuration, wherein the one or more strip-shaped wall sections are not folded into the pocket to hold the beverage container in a clamp seat in the pocket when the selected beverage container comprises a conical beverage container, and forming the pocket o a second pocket configuration wherein the one or more strip-shaped wall sections are folded into the interior of the pocket to form the bottom support member and support a bottommost end of the beverage container when the selected beverage container comprises at least one substantially vertical sidewall that horizontal surface of the receiving chamber; and inserting the selected beverage container into the pocket.

2. The method according to claim 1, wherein the pocket has two strip-shaped wall sections on adjacent corners, respectively, both of which are spaced from the receiving chamber.

3. The method according to claim 1, wherein the step of configuring the pocket to the second pocket configuration comprises folding the strip-shaped wall sections from the exterior of the container into the interior of the pocket.

4. The method of claim 1, further comprising selecting a beverage container from among one or more cups having a conical configuration and one or more bottles.

5. A method of using a packaging unit with a selected beverage container, the method comprising the steps of:

obtaining a packaging unit having a receiving chamber for popcorn or the like and a pocket coupled to the outside of the receiving chamber, wherein the pocket is square in plan, wherein on a lower end portion of the pocket, two strip-shaped wall sections are partially cut free at adjacent corners of the pocket in parallel with a lower edge of the pocket, the strip-shaped wall sections being spaced apart from the receiving chamber, and wherein the pocket further comprises fold lines at each end of the strip-shaped wall sections;

selecting a conical beverage container or a beverage container having at least one substantially vertical sidewall that is perpendicular to a horizontal surface of the receiving chamber;

forming the pocket based on the configuration of the selected beverage container into:

a first pocket configuration wherein the two strip-shaped wall sections are not folded into the pocket such that pocket is configured as sleeve with an open top and an open bottom, and a second pocket configuration by folding the strip-shaped wall sections at the fold lines into the interior of the pocket so that the strip-shaped wall sections extend at least partially into the interior of the pocket and form a partial bottom support member at the bottom of the pocket; and inserting the selected beverage container into the correspondingly configured pocket, wherein in the first pocket configuration the conical beverage container is held in a clamp seat in the pocket, and in the second pocket configuration the container having at least one substantially vertical sidewall is supported on the partial bottom support member.

6. A method of using a packaging unit with a selected beverage container, the method comprising the steps of:

obtaining a packaging unit having a receiving chamber for popcorn or the like and a pocket coupled to the outside of the receiving chamber, wherein a lower end portion of the pocket includes two strip-shaped wall sections that are partially cut free at adjacent corners of the pocket, the strip-shaped wall sections being spaced from the receiving chamber, and wherein the pocket further comprises fold lines at each end of the strip-shaped wall sections;

selecting a conical beverage container or a substantially cylindrical beverage container;

forming the pocket based on the configuration of the selected beverage container into:

a first pocket configuration wherein the two strip-shaped wall sections are not folded into the pocket such that pocket is configured as a sleeve with an open top and an open bottom, and a second pocket configuration by folding the strip-shaped wall sections at the fold lines into the interior of the pocket so that the strip-shaped wall sections extend at least partially into the interior of the pocket and form a partial bottom support member at the bottom end of the pocket; and inserting the selected beverage container into the correspondingly configured pocket, wherein in the first pocket configuration, the conical beverage container is held in a clamp seat in the pocket, and wherein in the second pocket configuration, a bottommost end of the substantially cylindrical beverage container has a diameter that substantially spans an entire width of each of said strip-shaped wall sections so that the substantially cylindrical beverage container is seated on the partial bottom support member.

* * * * *